United States Patent [19]

Smorzaniuk

[11] 4,048,607

[45] Sept. 13, 1977

[54] CIRCUIT BREAKER

[75] Inventor: Adam Smorzaniuk, West Millington, N.J.

[73] Assignee: Amerace Corporation, New York, N.Y.

[21] Appl. No.: 699,366

[22] Filed: June 24, 1976

[51] Int. Cl.[2] ..... H01H 73/48

[52] U.S. Cl. ..... 337/53; 335/23; 335/27; 337/56

[58] Field of Search ..... 335/23, 26, 27, 35; 337/53, 54, 55, 56, 365, 366, 367

[56] References Cited

U.S. PATENT DOCUMENTS

| | | | |
|---|---|---|---|
| 2,813,946 | 11/1957 | Cox | 337/53 X |
| 3,566,318 | 2/1971 | Gelzheiser et al. | 335/23 X |
| 3,936,780 | 2/1976 | Hennemann | 335/23 |

*Primary Examiner*—Robert J. Hickey
*Attorney, Agent, or Firm*—S. Michael Bender

[57] ABSTRACT

A circuit breaker has a bistable snap-acting mechanism including a bimetallic arm which renders the circuit breaker capable of actuation by either ambient temperature changes or temperature changes generated internally, as by an excessive electric current. An electromagnetic arrangement enables essentially instantaneous actuation in response to an electric current of predetermined amplitude greater than the excessive current which otherwise might actuate the circuit breaker thermally. An actuating lever assembly includes an actuating lever coupled to a link which is normally latched and is unlatched in response to movement of the bimetallic arm, and enables manual actuation, as well as manual reset of the circuit breaker.

15 Claims, 8 Drawing Figures

CIRCUIT BREAKER

The present invention relates generally to circuit breakers and pertains, more specifically, to a circuit breaker construction which opens a circuit in response to a thermally actuated mechanism, an electromagnetically actuated mechanism, or a manually actuated mechanism, and which may be reset manually to close the circuit.

A wide variety of circuit breakers is available commercially to provide for the opening of circuits in response to various conditions. Many such devices protect against overloads in an electrical circuit by opening the circuit in response to temperature changes resulting from a relatively continuous overload current which exceeds a predetermined magnitude. Other devices are available for instantaneously opening an electrical circuit by means of an electromagnetic mechanism responsive to sudden large increases in current, as would occur in a circuit fault condition. Some of the devices optionally may be actuated manually and most can be reset manually.

It is an object of the present invention to provide a circuit breaker which combines the advantages of thermal, electromagnetic and manual actuation with a simplified construction capable of economic manufacture.

Another object of the invention is to provide a circuit breaker of simplified construction which can open a circuit in response to a change in temperature resulting from external, ambient conditions or from internally generated conditions, and can be reset manually.

Still another object of the invention is to provide a circuit breaker of simplified construction which, in addition to thermal actuation resulting from a simple overload electrical current existing over a period of time, can be actuated electromagnetically, essentially instantaneously, in response to a sudden increase in electrical current beyond a predetermined magnitude, such as would result from a sudden fault condition in the circuit.

A further object of the invention is to provide a circuit breaker of simplified construction which, in addition to thermal and electromagnetic actuation capabilities, may be actuated manually, as well as reset manually.

A still further object of the invention is to provide a circuit breaker which can be actuated in a thermal mode or an electromagnetic mode and which, after actuation, provides a visible indication of which mode of actuation occurred for visual determination of the circuit condition which effected actuation of the circuit breaker.

Another object of the invention is to provide a circuit breaker of the type described and which employs a minimum number of component parts of simplified design and construction, the parts being easily assembled to fabricate a relatively inexpensive, reliable device.

The above objects, as well as still further objects and advantages are attained by the present invention which may be described briefly as a circuit breaker for opening a circuit in response to a given temperature change and capable of being reset manually, the circuit breaker comprising a frame, a first contact member affixed to the frame, an actuating lever assembly mounted upon the frame for pivotal movement between a first position and a second position, a bimetallic arm carried by the actuating lever assembly for pivotal movement therewith and having a first end affixed to the actuating lever assembly and a second end juxtaposed with the first contact member, the bimetallic arm having a bistable configuration conformable to either one of first and second stable postures such that the second end rests at either one of corresponding first and second locations relative to the first end, the second end being movable in a first direction relative to the first end in response to the given temperature change to effect movement of the bimetallic arm with a snap-action along a prescribed path of travel between the first stable posture and the second stable posture and conform the bimetallic arm to the second stable posture, a second contact member located adjacent the second end of the bimetallic arm such that the first and second contact members are engaged and the circuit is closed when the actuating lever assembly is in the first position and the bimetallic arm is in the first stable posture, and the contact members are disengaged, and the circuit is open, when the bimetallic arm is in the second stable posture, resilient biasing means biasing the actuating lever assembly toward the second position, holding means for maintaining the actuating lever assembly stationary at the first position, the holding means being responsive to movement of the bimetallic arm from the first stable posture to the second stable posture to release the actuating lever assembly for movement toward the second position in response to the biasing means, and stop means for precluding movement of the second end of the bimetallic arm in the first direction when the actuating lever assembly reaches an intermediate position between the first and second positions, while permitting continued pivotal movement of the actuating lever assembly to the second position to move the first end of the bimetallic arm relative to the second end and conform the bimetallic arm to the first stable posture, whereby return of the actuating lever assembly to the first position thereof will again engage the first and second contact members.

The invention will be more fully understood, while still further objects and advantages thereof will become apparent, in the following detailed description of an embodiment of the invention illustrated in the accompanying drawing, in which.

Figure 1:
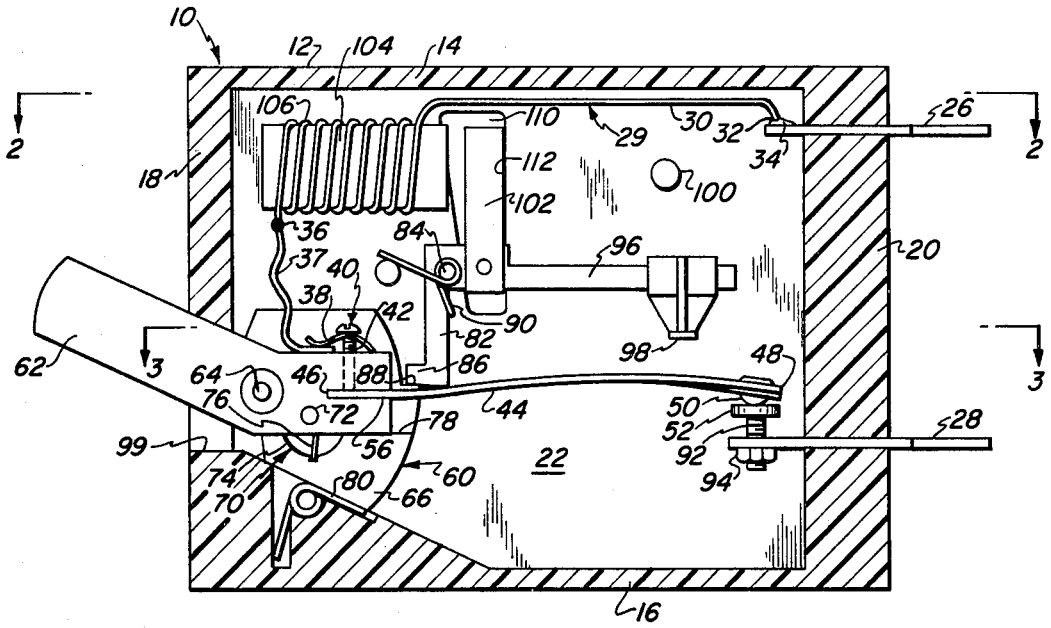
FIG. 1 is a longitudinal cross-sectional view of a circuit breaker constructed in accordance with the invention.
Figure 2:
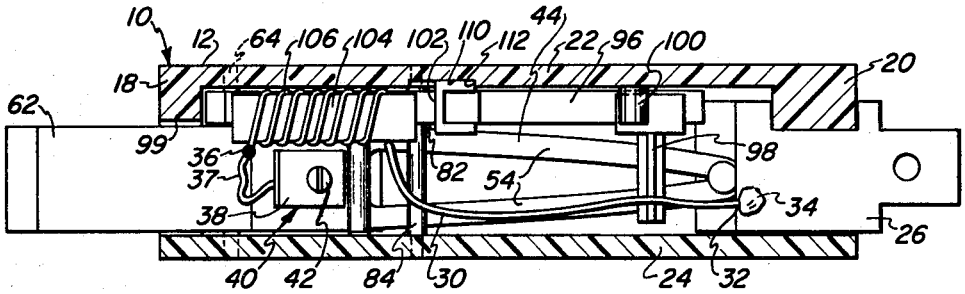
FIG. 2 is a cross-sectional view taken along line 2—2 of FIG. 1.
Figure 3:
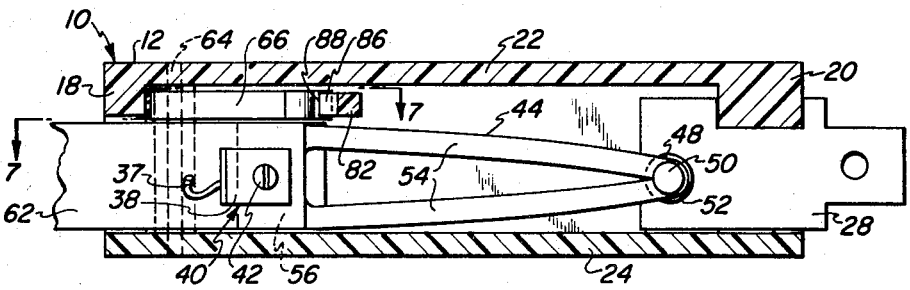
FIG. 3 is a cross-sectional view taken along line 3—3 of FIG. 1.

Referring now to the drawing, and especially to FIG. 1 thereof, a circuit breaker constructed in accordance with the invention is illustrated at 10 and is seen to have a frame 12 which includes a top wall 14, a bottom wall 16, a left side wall 18, a right side wall 20, a rear wall 22 and a front wall 24 (see FIGS. 2 and 3). Preferably, all of the walls of the frame are formed in a unitary structure, with the exception of the front wall 24 which is removably secured to the remainder of the frame to provide access to the interior of the device.

A pair of electrical terminals 26 and 28 extend through the right side wall 20 and provide the means by which circuit breaker 10 is connected into an external electric circuit which is to be protected by the circuit breaker. An internal electric circuit 29, within the circuit breaker 10, includes a conductor 30 having one end 32 electrically and mechanically connected to terminal 26, as by soldering at 34, and another end 36 attached to a flexible lead 37 secured at one end thereof beneath a retainer 38 of an electrically conductive fastener 40, which includes the retainer 38 and a conductive screw 42. Conductive screw 42 contacts a bimetallic arm 44, adjacent one end 46 of the arm. The other end 48 of the bimetallic arm 44 is juxtaposed with terminal 28 and carries an electrical contact member 50, here shown engaged with a corresponding contact member 52 affixed to terminal 28 to complete the internal circuit 29 between terminals 26 and 28.

As best seen in FIGS. 2 and 3, as well as in FIG. 1, bimetallic arm 44 includes a pair of legs 54 which extend from a common base 56 at end 46 and are fastened together at the other end 48. The bimetallic arm has been constructed by first making, from bimetallic stock, a flat U-shaped member (not shown), including base 56 and legs 54 extending therefrom parallel to one another, and then bringing the legs 54 toward one-another by flexing the legs without permanent deformation, to overlap the legs 54 at end 48 where the legs are secured together by contact member 50, which serves as a rivet. The resulting bowed structure will provide a bistable, snap-action mechanism in that the bimetallic arm 44 is conformable to either one of two stable postures, the first posture being a bowed configuration where end 48 will tend to rest below end 46, as seen in FIG. 1, and the second posture being bowed in the opposite direction, with end 48 tending to rest above end 46. Movement between the two stable postures occurs in a rapid, "snap-action" fashion. By choosing the appropriate bimetallic stock material, a change in the temperature of the bimetallic arm can be made to actuate the arm from one stable posture to the other. The temperature change can be generated either externally, by ambient conditions, or internally by electrical resistance heating.

Bimetallic arm 44 is affixed at end 46 thereof to an actuating lever assembly 60 which includes an actuating lever 62 mounted upon frame 12 for pivotal movement about the central longitudinal axis of a shaft 64 carried by the frame. Actuating lever assembly 60 includes a link 66, also mounted for pivotal movement on shaft 64, alongside of actuating lever 62. Link 66 and actuating lever 62 are coupled for movement together by a detent assembly 70 (see FIG. 7) which includes a detent pin 72 affixed to actuating lever 62 and extending into a cavity 74 in link 66, and a detent leaf spring 76 affixed within link 66 and extending across cavity 74 to engage detent pin 72 and resiliently urge actuating lever 62 downwardly (in a clockwise direction as viewed in FIG. 1 and a counterclockwise direction as viewed in FIG. 7) against a ledge 78 on link 66. In this manner, actuating lever 62 and link 66 are resiliently coupled for pivotal movement with one-another on shaft 64.

Link 66 is resiliently biased upwardly (in a counterclockwise direction, as viewed in FIG. 1) by resilient biasing means in the form of a spring 80, but is secured against such upward movement by holding means which includes a latch 82 mounted on the frame 12 for pivotal movement about the longitudinal axis of pin 84 and carrying a latch tooth 86 urged into engagement with a shoulder 88 on link 66 by a spring 90. The longitudinal axis provided by pin 84 is parallel to the axis provided by shaft 64 and is located between shaft 64 and the free end 48 of bimetallic arm 44. Thus, with the circuit breaker 10 in the ON condition illustrated in FIG. 1, the actuating lever assembly 60 is positively latched in the position shown, the bimetallic arm 44 is in the first stable posture and the contact members 50 and 52 are engaged to close the internal circuit 29 within the circuit breaker. Contact member 52 is adjustable toward and away from contact member 50 by means of a threaded rod 92 which depends from contact 52 and is threaded into terminal 28. Adjustment of contact member 52 is made for appropriate contact pressure and for accurate location of end 48 of bimetallic arm 44 to assure proper snap-action operation, as will be described below in greater detail. Once such adjustment is made, a lock nut 94 secures the adjustment.

With the circuit breaker in the ON condition illustrated in FIG. 1, electric current can pass between terminals 26 and 28, via the internal circuit 29 within the circuit breaker. Current passing through bimetallic arm 44 will tend to heat the arm by electrical resistance heating generated by the electrical resistance of the material of the arm itself. The bimetallic material is chosen such that heating of the bimetallic arm 44 will tend to move end 48 of the bimetallic arm upwardly, relative to end 46, and urge the arm out of the first stable posture and into the second stable posture. Should the current exceed a predetermined value over a period of time long enough to heat the bimetallic arm 44 and effect the appropriate temperature change, the bimetallic arm will move to the second stable posture, with a snap-action, in response to the temperature change. Contact members 50 and 52 will be separated and the circuit 29 will be broken, thus providing the desired circuit protection.

As the bimetallic arm 44 moves to conform to the second stable posture, the arm will move in an upward direction, as viewed in FIG. 1, along a prescribed path of travel. As best seen in FIG. 2, as well as in FIG. 1, latch 82 includes an extension 96 which carries a tripping means in the form of a finger 98 extending over the bimetallic arm 44 and into the path of travel of the bimetallic arm. As the bimetallic arm 44 moves upwardly, the arm engages the finger 98 and moves the latch 82 against the bias of spring 90 to release latch tooth 86 from shoulder 88, thereby freeing link 66 for movement in response to the bias force of spring 80, together with actuating lever 62, until the link 66 and lever 62 come to rest in the position shown in FIG. 4. Contact members 50 and 52 become fully open.

Figure 4:
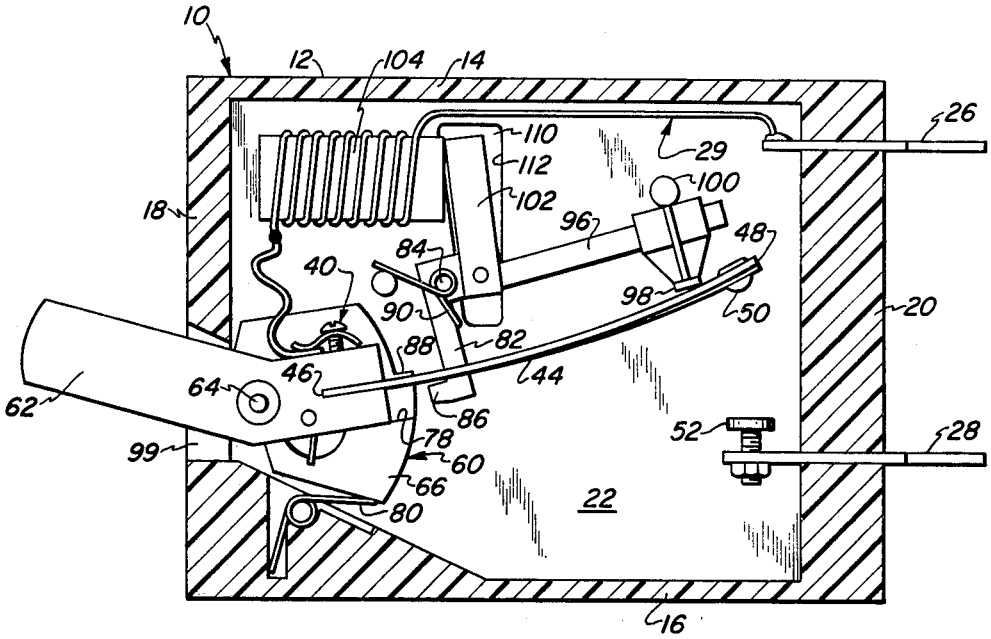
FIG. 4 is a cross-sectional view similar to FIG. 1, but with the component parts in another operating postion.

When in the intermediate position illustrated in FIG. 4, the actuating lever 62, which projects through an aperture 99 in left side wall 18, indicates visually, by enabling the actuating lever to be viewed in the intermediate position, that a thermal break has occurred. In order to reset the circuit breaker 10, the actuating lever 62 is moved downwardly, manually, beyond the intermediate position shown in FIG. 4, to the position shown in FIG. 5. Stop means, shown in the form of a post 100 integral with and projecting from rear wall 22 and engaging the extension 96 of the latch 82 to prevent upward movement of the extension 96 beyond the position shown in FIGS. 4 and 5, precludes further upward movement of end 48 of bimetallic arm 44 so that movement of actuating lever 62 downwardly, to the position shown in FIG. 5, moves end 46 to bimetallic arm 44 relative to end 48 to return the bimetallic arm to the first stable posture, illustrated in FIG. 5. Actuating lever 62 is then returned to the initial position, shown in FIG. 1, and the circuit breaker 10 is in the ON condition. Actuation of circuit breaker 10 in the thermal mode in response to a temperature change due to external ambient conditions would be the same as described above.

In the event of a fault current of sudden, high value in excess of a predetermined current handling ability, and greater than the value which would cause a thermal break as described above, circuit breaker 10 will respond immediately to open the internal circuit 29. Thus, an armature 102 is mounted upon the latch 82 and extends upwardly therefrom toward an electromagnet 104 placed in the internal circuit 29 within the circuit breaker 10. A sudden surge of current through conductor 30, a portion 106 of which serves as the coil of the electromagnet 104, will draw the armature 102 to the electromagnet 104, thereby moving the latch 82 to disengage the latch tooth 86 from shoulder 88 and enabling the actuating lever assembly 60 to move to the position shown in FIG. 5, whereby the contact members 50 and 52 are separated to open the circuit. The actuating lever 62 has gone directly to the lowermost, or FULL OFF position, visibly indicating an electromagnetic break. It is noted that in such an electromagnetic break, the circuit breaker reacts so quickly that insufficient time is available for the bimetallic arm 44 to heat up and move to the second stable posture. Reset is accomplished merely by returning the actuating lever 62 to the intial ON position shown in FIG. 1.

Figure 5:
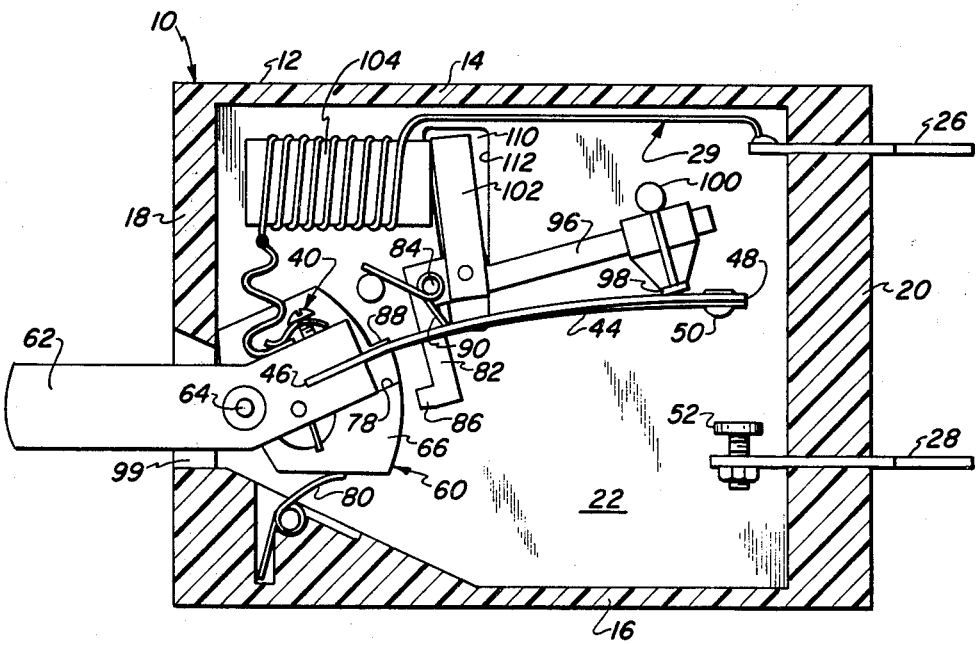
FIG. 5 is a cross-sectional view similar to FIG. 1, but with the component parts in still another operating position.

The armature 102 is mounted for rotation relative to latch 82 by means of a pivot pin 106; however, rotation is permitted only in a direction clockwise from the position generally normal to the latch 82, as seen in FIG. 1; and the amount of rotation is confined to a relatively small angle by limiting means in the form of a recess 110 in the rear wall 22, within which recess the armature is placed (see FIG. 2) so that the perimeter of the recess serves to preclude rotation of the armature beyond the small angular movement. In this manner, latch 82 is permitted greater pivotal movement in the counterclockwise direction, as seen in FIGS. 4 and 5, and the armature 102 is returned to the normal orientation, as seen in FIG. 1, by contact with edge 112 of recess 110.

Figure 6:
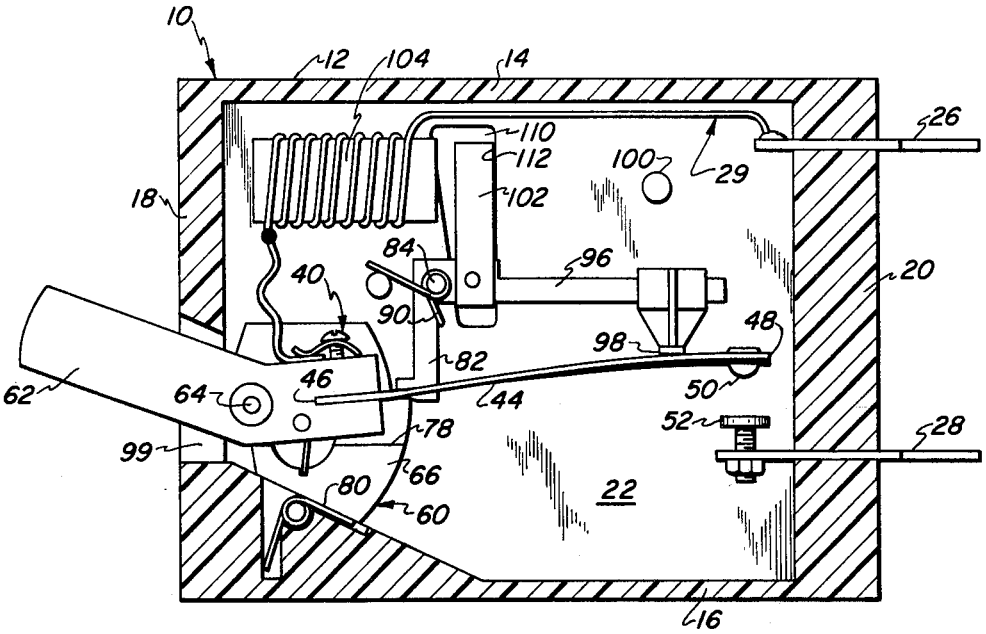
FIG. 6 is a cross-sectional view similar to FIG. 1, but with the component parts in a further operating position.
Figure 7:
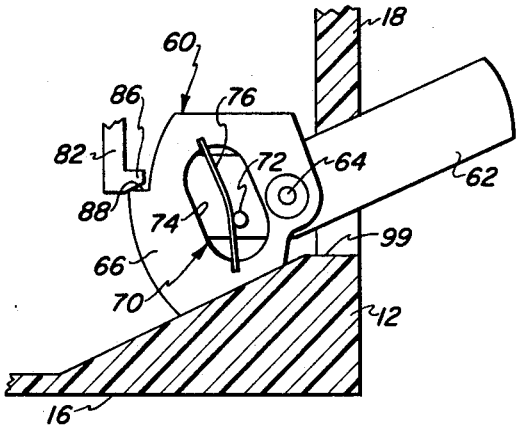
FIG. 7 is a fragmentary cross-sectional view taken along line 7—7 of FIG. 3.
Figure 8:
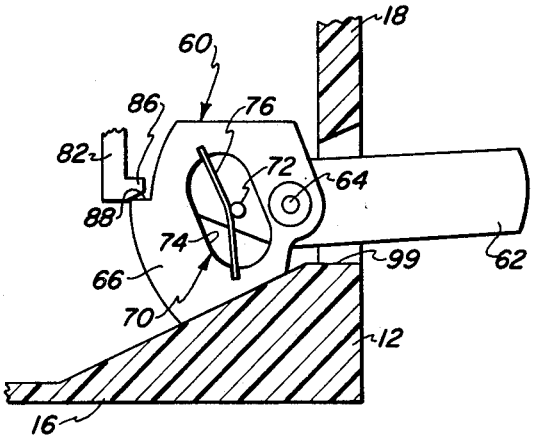
FIG. 8 is a fragmentary cross-sectional view similar to FIG. 7, but with the component parts in another operating position.

Turning now to FIGS. 6, 7 and 8, as well as to FIG. 1, circuit breaker 10 may be actuated from the ON condition to the OFF condition manually by merely moving actuating lever 62 from the ON position, in FIG. 1, to the FULL OFF position. Such manual actuation is permitted by the detent assembly 70 which enables manual actuation to move the actuating lever 62 downwardly relative to link 66, as seen in FIGS. 6 and 8. Such downward movement of actuating lever 62 will raise the bimetallic arm 44, as seen in FIG. 6, until the arm engages finger 98. Continued downward movement of actuating lever 62 will then move the latch 82 to disengage the latch tooth 86 from shoulder 88, thereby enabling the circuit breaker 10 to assume the FULL OFF condition illustrated in FIG. 5. Reset is accomplished by returning the actuating lever 62 to the ON position illustrated in FIG. 1.

Circuit breaker 10 thus incorporates a relatively simple mechanism of relatively few parts which are easy to fabricate and are readily assembled to enable the economical manufacture of an inexpensive yet versatile circuit breaker.

It is to be understood that the above detailed description of an embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A circuit breaker for opening a circuit in response to a given temperature change and capable of being reset manually, said circuit breaker comprising:

a frame;

a first contact member affixed to the frame;

an actuating lever assembly mounted upon the frame for pivotal movement between a first position and a second position;

a bimetallic arm carried by the actuating lever assembly for pivotal movement therewith and having a first end affixed to the actuating lever assembly and a second end juxtaposed with the first contact member, the bimetallic arm having a bistable configuration conformable to either one of first and second stable postures such that the second end rests at either one of corresponding first and second locations relative to the first end, the second end being movable in a first direction relative to the first end in response to said given temperature change to effect movement of the bimetallic arm with a snap-action along a prescribed path of travel between the first stable posture and the second stable posture and conform the bimetallic arm to the second stable posture;

a second contact member located adjacent the second end of the bimetallic arm such that the first and second contact members are engaged and the circuit is closed when the actuating lever assembly is in the first position and the bimetallic arm is in the first stable posture, and the contact members are disengaged, and the circuit is open, when the bimetallic arm is in the second stable posture;

resilient biasing means biasing the actuating lever assembly toward the second position;

holding means for maintaining the actuating lever assembly stationary at the first position, said holding means being responsive to movement of the bimetallic arm from the first stable posture to the second stable posture to release the actuating lever assembly for movement toward the second position in response to the biasing means; and stop means for precluding movement of the second end of the bimetallic arm in said first direction when the actuating lever assembly reaches an intermediate position between said first and second positions, while permitting continued pivotal movement of the actuating lever assembly to the second position to move the first end of the bimetallic arm relative to the second end and conform the bimetallic arm to the first stable posture, whereby return of the actuating lever assembly to the first position thereof will again engage the first and second contact members.

2. The invention of claim 1 wherein the second contact member is carried by the bimetallic arm adjacent the second end thereof.

3. The invention of claim 2 wherein the circuit breaker has an internal electric circuit for conducting electric current through the circuit breaker, the bimetallic arm being in said internal circuit such that the given temperature change is effected by electrical resistance heating of the bimetallic arm generated by the current passing through the arm.

4. The invention of claim 3 including:

an electromagnetic means in the internal circuit and located upon the frame proximate to said holding means;

means including an armature coupled with the holding means and juxtaposed with the electromagnetic means such that upon passing a predetermined electric current through the electromagnetic means, the armature will be actuated to release the actuating lever assembly for movement from the first position toward the second position, in response to the resilient biasing means, with the bimetallic arm remaining in the first stable posture, whereby the actuating lever assembly will be urged by the resilient biasing means directly to the second position.

5. The invention of claim 4 wherein the actuating lever assembly includes means for providing a visible indication of the position of the actuating lever assembly subsequent to movement of the actuating lever assembly from the first position thereof so that the mode of operation of the circuit breaker can be identified by viewing the position of the actuating lever assembly.

6. The invention of claim 2 wherein the holding means includes:

a latch mounted on the frame for engagement with the actuating lever assembly to maintain the actuating lever assembly stationary at the first position; and tripping means located in the prescribed path of travel of the bimetallic arm and coupled to the latch such that as the bimetallic arm moves from the first stable posture to the second stable posture, while the actuating lever assembly remains stationary at the first position, the tripping means will be engaged and moved by the bimetallic arm to release the latch and enable movement of the actuating lever assembly toward the second position in response to the biasing means.

7. The invention of claim 6 wherein the circuit breaker has an internal electric circuit for conducting electric current through the circuit breaker, the circuit breaker including:

an electromagnet in the internal circuit and located upon the frame proximate to the latch;

an armature on the latch and juxtaposed with the electromagnet such that upon passing a predetermined electric current through the electromagnet, the armature will be actuated to release the latch from the actuating lever assembly so as to enable movement of the actuating lever assembly from the first position directly to the second position, in response to the resilient biasing means, with the bimetallic arm remaining in the first stable posture.

8. The invention of claim 7 wherein the actuating lever assembly includes means for providing a visible indication of the position of the actuating lever assembly subsequent to movement of the actuating lever assembly from the first position thereof so that the mode of operation of the circuit breaker can be identified by viewing the position of the actuating lever assembly.

9. The invention of claim 6 wherein the tripping means includes a finger integral with the latch and projecting into the path of travel of the bimetallic arm.

10. The invention of claim 9 wherein the stop means includes means for precluding movement of the finger beyond a location where the second end of the bimetallic arm is in the second location, the actuating lever assembly is in the intermediate position and the bimetallic arm engages the finger.

11. The invention of claim 10 wherein the stop means includes a post integral with the frame and engaging the latch when the finger is in said location.

12. The invention of claim 10 wherein the actuating lever assembly comprises:

a manually operated actuating lever mounted for pivotal movement on the frame between said first and second positions, said bimetallic arm being affixed to said actuating lever;

a link mounted for pivotal movement on the frame between first and second locations corresponding to said first and second positions, said resilient biasing means engaging the link for biasing the link toward the second location thereof;

a shoulder on the link, the shoulder being located so as to be engaged by the latch for retaining the link in the first location;

coupling means coupling the actuating lever for movement with the link upon release of the latch by the tripping means, said coupling means enabling selective manual movement of the actuating lever from the first position toward the second position relative to the link, enabling manual pivotal movement of the bimetallic arm to disengage the first and second contacts and operate the tripping means, while the link is held stationary by the latch.

13. The invention of claim 12 wherein the actuating lever and the link are mounted for pivotal movement about the same first axis of rotation and the latch is mounted for pivotal movement about a second axis of rotation parallel to the first axis of rotation and located between the first axis of rotation and the second end of the bimetallic arm.

14. The invention of claim 12 wherein the coupling means includes a resilient detent mechanism for selectively securing the actuating lever and the link in a predetermined position relative to one another, said resilient detent mechanism enabling selective manual movement of the actuating lever relative to the link when the link is held stationary by the latch.

15. The invention of claim 14 wherein said selective manual movement is in the direction from the first position toward the second position of the actuating lever assembly.

* * * * *